US005411786A

United States Patent [19]

Kuo

[11] Patent Number: 5,411,786

[45] Date of Patent: May 2, 1995

[54] CORRUGATED BOARD-MADE SCAFFOLD BOARD STRUCTURE WITH HIGH STRENGTH

[75] Inventor: Shin C. Kuo, Changhua City, Taiwan, Prov. of China

[73] Assignee: Ta Yen Paper Box Container Co., Ltd., Changhua City, Taiwan, Prov. of China

[21] Appl. No.: 137,476

[22] Filed: Oct. 18, 1993

[51] Int. Cl.[6] ..... B32B 3/28; B65D 19/34

[52] U.S. Cl. ..... 428/184; 428/90; 428/119; 428/182; 108/51.3

[58] Field of Search ..... 428/182, 184, 120, 90, 428/188, 163, 119, 192, 212; 108/51.3, 56.5, 56.1; 248/34.6

[56] References Cited

U.S. PATENT DOCUMENTS

| | | | |
|---|---|---|---|
| 3,380,403 | 4/1968 | Sullivan | 108/51 |
| 3,606,844 | 9/1971 | Lubker et al. | 108/58 |
| 5,129,329 | 7/1992 | Clasen | 108/51.3 |
| 5,156,094 | 10/1992 | Johansson | 108/51.3 |
| 5,327,839 | 7/1994 | Herring et al. | 108/51.3 |
| 5,366,790 | 11/1994 | Liebel | 428/184 |

*Primary Examiner*—Donald J. Loney
*Attorney, Agent, or Firm*—Browdy and neimark

[57] ABSTRACT

A corrugated board made scaffold board structure with high strength, including a bearing board and several leg boards disposed thereunder. The bearing board is composed of a lower longitudinal corrugated board, a middle transverse corrugated board and an upper longitudinal corrugated board which are attached to one another. Each of the leg boards is composed of several corrugated boards attached to one another. Alternatively, the scaffold board structure can be composed of several bearing boards and several leg boards, wherein each of the bearing boards is composed of several corrugated boards having a relatively small width and attached to one another. Each of the corrugated boards is made of A-class flock paper with high compression strength and is vertically disposed. On two lateral sides of each the corrugated board are attached several carton boards. A layer of solvent-free thermo-melting glue (EVA, ethylene-vinyl acetate resin) is painted on an upper surface of the bearing board to increase bearing strength and hardness of the scaffold board.

6 Claims, 4 Drawing Sheets

CORRUGATED BOARD-MADE SCAFFOLD BOARD STRUCTURE WITH HIGH STRENGTH

BACKGROUND OF THE INVENTION

The present invention relates to a disposable reusable corrugated board-made scaffold board structure with high strength, including a bearing board and several leg boards disposed thereunder. The bearing board is composed of a lower longitudinal corrugated board, a middle transverse corrugated board and an upper longitudinal corrugated board which are attached to one another. Each of the leg boards is composed of several corrugated boards attached to one another. Alternatively, the scaffold board structure can be composed of several bearing boards and several leg boards, wherein each of the bearing boards is composed of several corrugated boards having a relatively small width and attached to one another. Each of the corrugated boards is made of A-class flock paper with high compression strength and is vertically disposed. On two lateral sides of each corrugated board are attached several carton boards. A layer of solvent-free thermo-melting glue (EVA, ethylene-vinyl acetate resin) is painted on an upper surface of the bearing board to increase the bearing strength and hardness of the scaffold board.

A conventional scaffold board structure serves as a pad disposed under an article to keep the same at a position free from contact with the ground so that a forklift can easily lift and displace the article. Such a scaffold board is composed of two longitudinal timbers and several transverse timbers connected therewith by nails in a cross pattern. Such a scaffold board is manufactured at high cost of labor and time and the production of such a scaffold board cannot be automated. Moreover, the conventional scaffold board has a considerably great weight so that it is difficult to displace the conventional scaffold board. In addition, the timbers connected by nails are liable to break apart due to collision, causing damage to any article placed thereon. Therefore, the useful life of the conventional scaffold board is short and the discarded ones are not recoverable for reuse. Furthermore, the timbers are obtained by cutting trees in the forests so that the area of the denuded forests will be increased. Also, because the price of the conventional scaffold board is relatively high, the competitive ability of the manufacturer will be reduced.

Therefore, it is necessary to provide an improved reusable scaffold board structure which can be easily manufactured at lower cost while having high strength.

SUMMARY OF THE INVENTION

It is therefore a primary object of the present invention to provide a disposable reusable corrugated board-made scaffold board structure with high strength which can be repeatedly used and is subject to natural decomposition so that the problem of pollution of environment can be improved.

It is a further object of the present invention to provide the above corrugated board-made scaffold board structure which can be easily manufactured at lower cost.

It is still a further object of the present invention to provide the above corrugated board-made scaffold board structure which can be automatically mass-produced.

According to the above objects, the present disposable recoverable corrugated board-made scaffold board structure with high strength includes a bearing board and several leg boards disposed thereunder. The bearing board is composed of a lower longitudinal corrugated board, a middle transverse corrugated board and an upper longitudinal corrugated board which are attached to one another. Each of the leg boards is composed of several corrugated boards attached to one another. Alternatively, the scaffold board structure can be composed of several bearing boards and several leg boards, wherein each of the bearing boards is composed of several corrugated boards having a relatively small width and attached to one another. Each of the corrugated boards is made of A-class flock paper with high compression strength and is vertically disposed. On two lateral sides of each the corrugated board are attached several carton boards. A layer of solvent-free thermo-melting glue (EVA, ethylene-vinyl acetate resin) is painted on an upper surface of the bearing board to increase the bearing strength and hardness of the scaffold board.

The structural features and advantages of the present invention, and the technical means adopted to achieve the present invention can be best understood through the following detailed description of the preferred embodiment and the accompanying drawings wherein:

DETAILED DESCRIPTION OF THE PREFERRED EMBODIMENT

Figure 1:
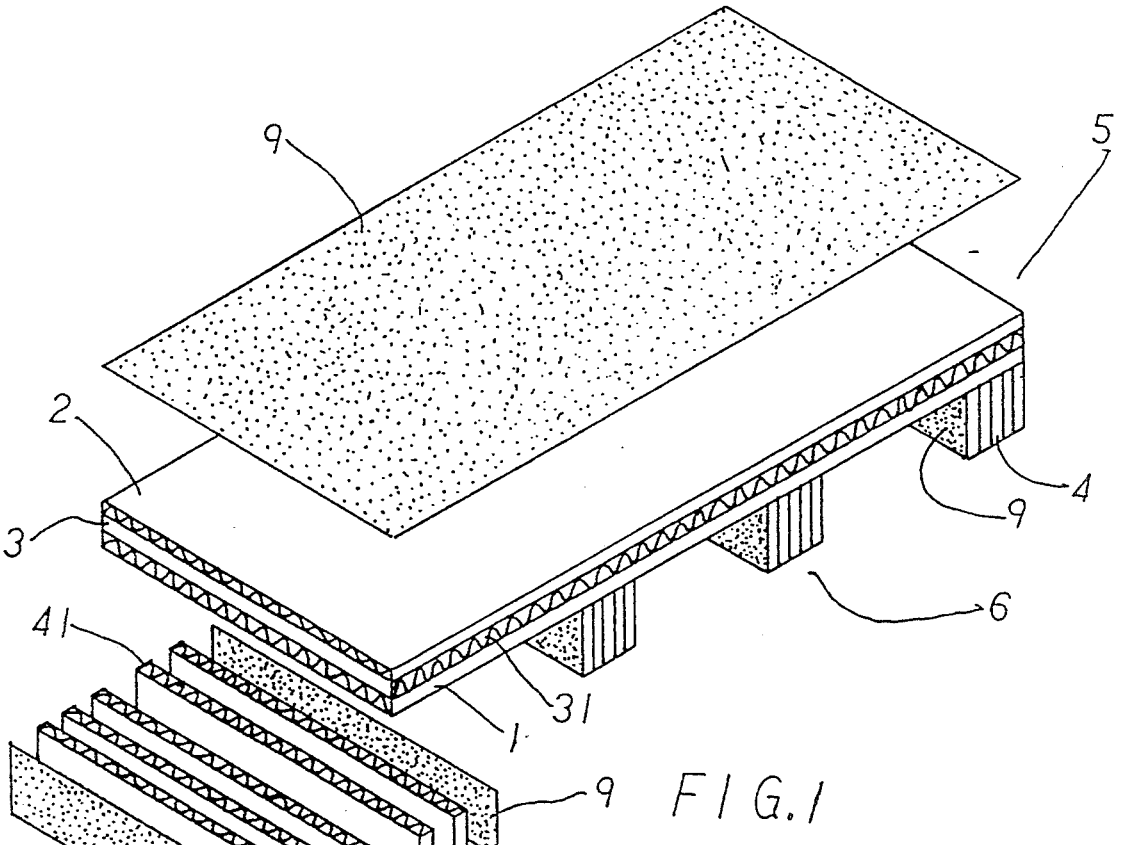
FIG. 1 is a perspective disassembled view of a first embodiment of the present invention.
Figure 2:
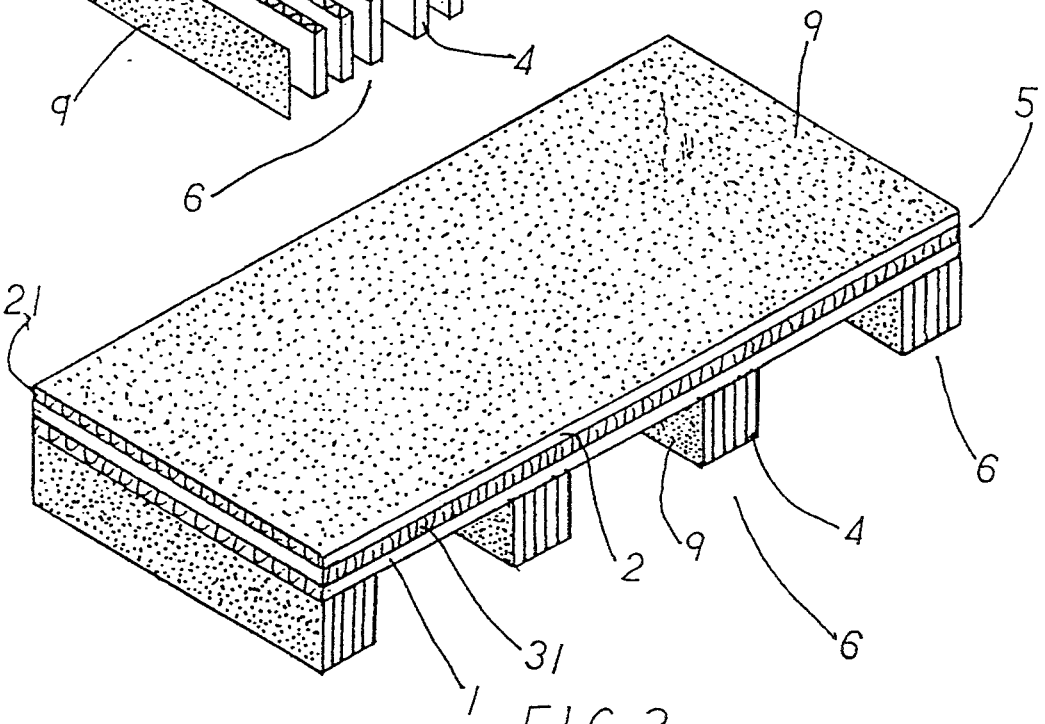
FIG. 2 is a perspective assembled view of the first embodiment of the present invention.

Please refer to FIGS. 1 and 2 which show a first embodiment of the present invention, including a bearing board 5 and several leg boards 6 disposed thereunder. The bearing board 5 is composed of a lower longitudinal corrugated board 1, a middle transverse corrugated board 3 and an upper longitudinal corrugated board 2. The lower, middle and upper corrugated boards 1, 3 and 2 are attached to one another by thermo-melting glue. Shock-absorbing and supporting rib members 11, 31 and 21 are respectively disposed within corrugations of the lower, middle and upper corrugated boards 1, 3 and 2 for reinforcing the same.

Each of the leg boards 5 is composed of about 10 corrugated boards 4 having the same width and attached to one another by thermo-melting glue. Shock-absorbing rib members 41 are disposed within corrugation of the corrugated boards 4 for reinforcing the same. In the first embodiment of the present invention, there are provided four leg boards 5 each of which is composed of more than 10 corrugated boards 4. However, due to the drafting limitation, only 5 corrugated boards 4 are shown in FIG. 1. The leg boards are connected under the bearing board 5 by thermo-melting glue. In addition, each of the edges of the connected bearing board 5 and the leg boards 5 are sealed by thermo-melting glue to eliminate any fissure therein.

Moreover, for enhancing the bearing ability and collision-resistance of the bearing board 5 and leg boards 6 against a forklift, on an upper surface of the bearing board 5 and two lateral sides of each leg board 6 are attached several layers of carton boards 9 to reinforce the bearing board 5 and leg boards 6.

Figure 3:
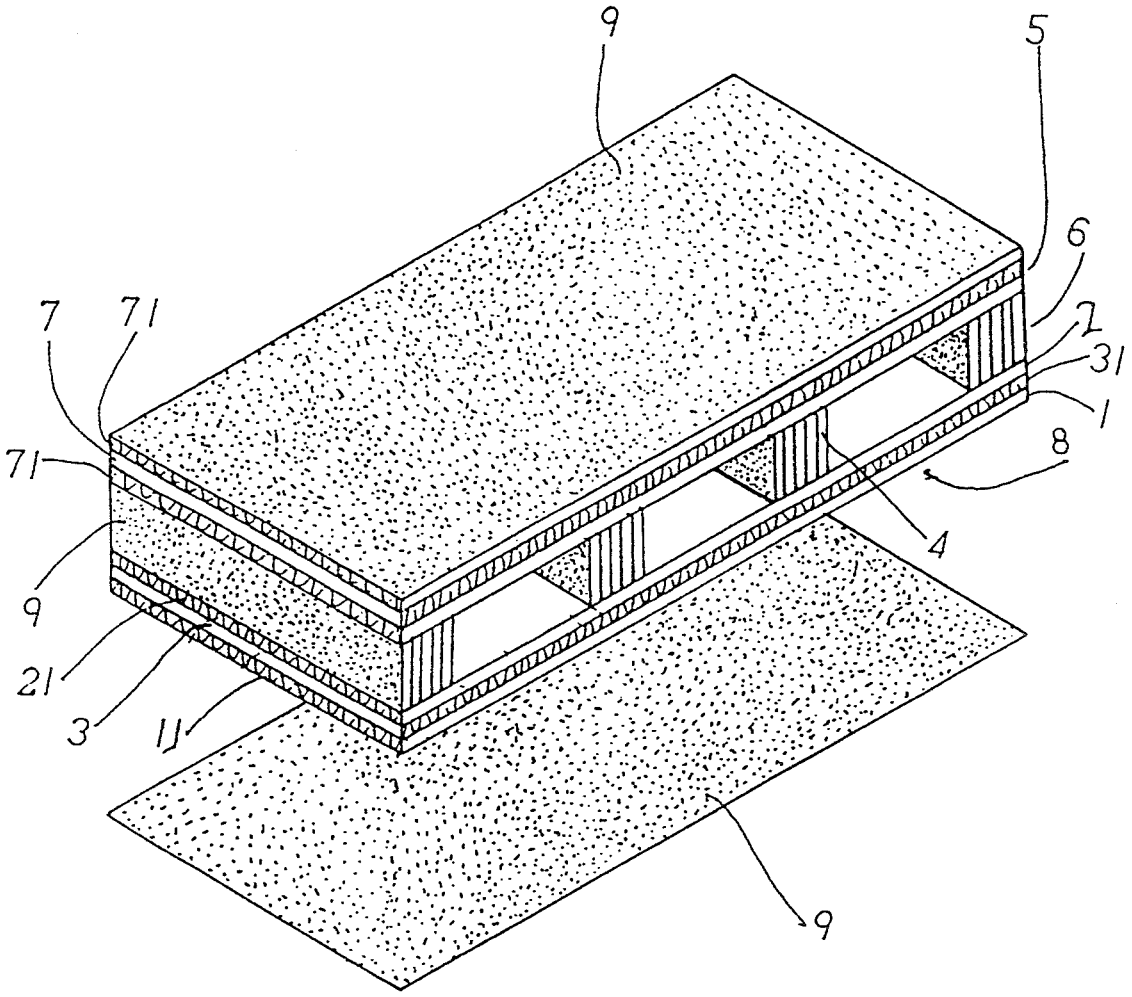
FIG. 3 is a perspective assembled view of a second embodiment of the present invention.

Please refer to FIG. 3 which shows a second embodiment of the present invention, wherein a bottom board 8 composed of multiple corrugated boards is attached to the leg boards 6 to further enhance the strength of the scaffold board of the present invention. Several layers of carton boards 9 are attached under a lower surface of the bottom board 8 for reinforcing the same.

Figure 4:
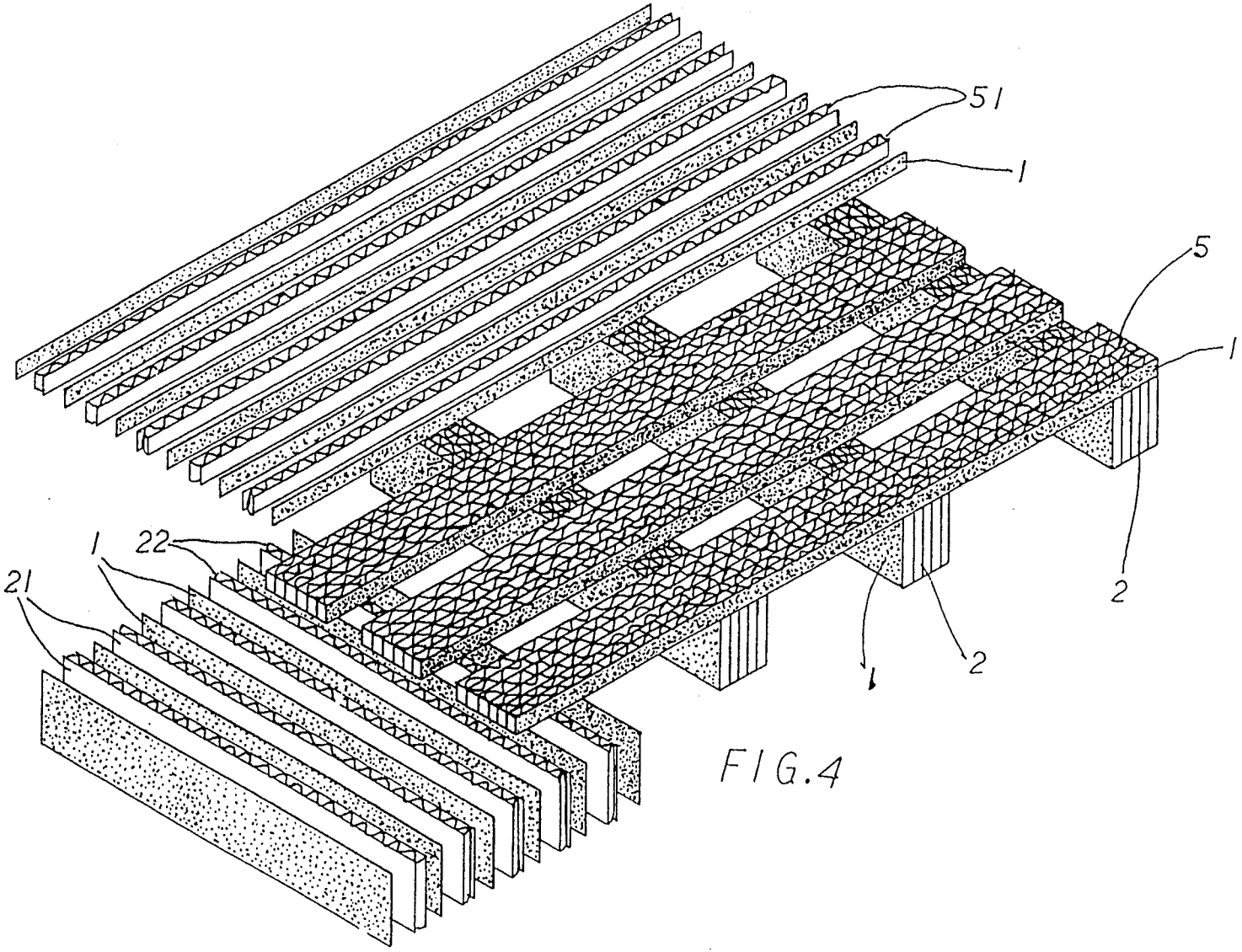
FIG. 4 is a perspective disassembled view of a third embodiment of the present invention.
Figure 5:
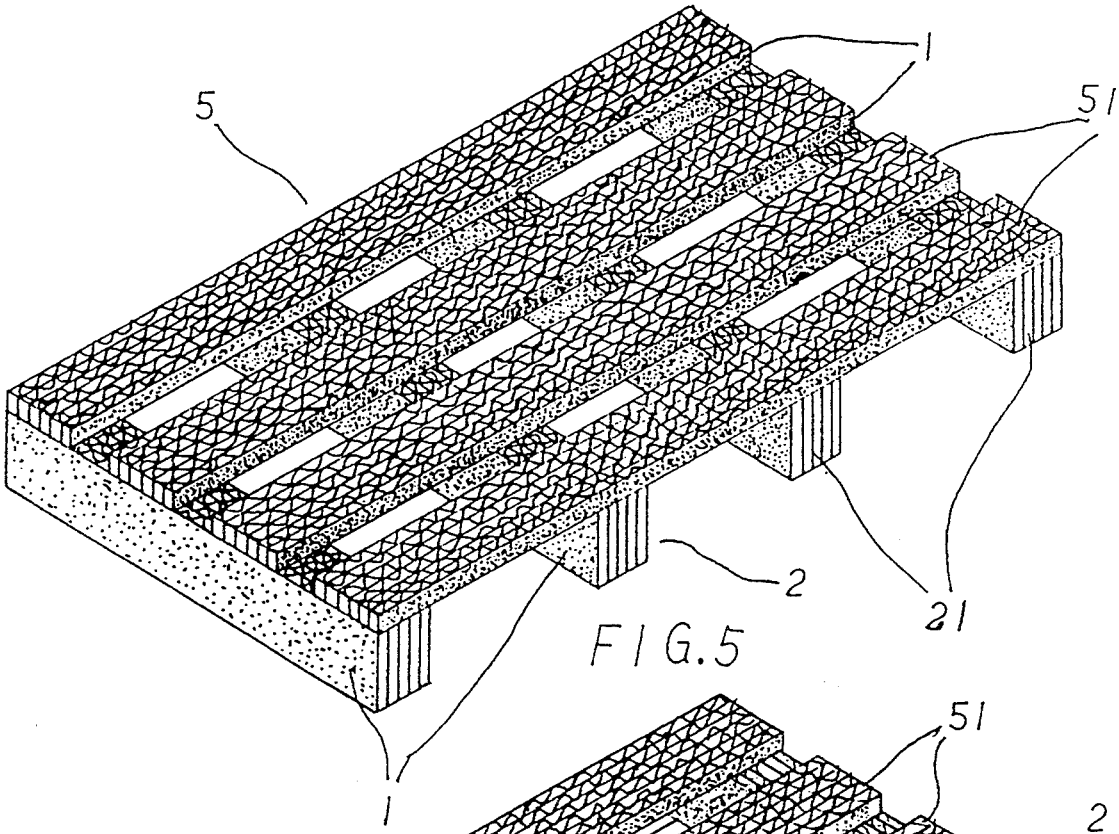
FIG. 5 is a perspective assembled view according to FIG. 4.
Figure 6:
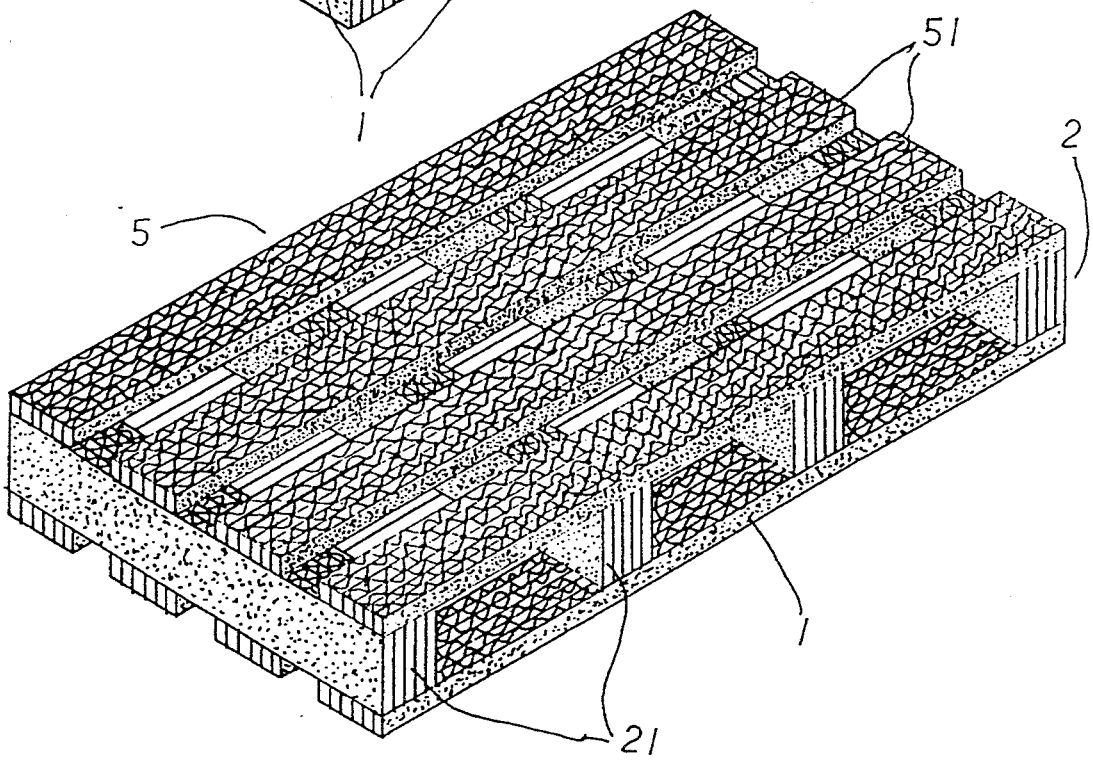
FIG. 6 is a perspective assembled view of a fourth embodiment of the present invention.

Please refer to FIGS. 4 and 5 which show a third embodiment of the present invention including several bearing boards 5 and several leg boards 2, wherein each of the bearing boards 5 is composed of several corrugated boards 51 having a relatively small width and attached to one another by thermo-melting glue. Each of the corrugated boards 51 is made of A-class flock paper with high compression strength and is vertically disposed. On two lateral sides of each corrugated board 51 are attached several carton boards 1 for reinforcing the same. Each of the leg boards 2 is composed of several corrugated boards 21 having a relatively large width and attached to one another by thermo-melting glue. On two lateral sides of each corrugated board 21 are attached several carton boards 1 for reinforcing the same. Shock-absorbing rib members 22 formed by waved flock paper are disposed in each corrugated board 21. The number of the corrugated boards 21 can be adjusted according to the load to bear. The bearing boards 5 and the leg boards 2 are connected in a cross pattern as shown in FIG. 5. Every edges of the connected bearing boards 5 and leg boards 2 are sealed by thermo-melting glue to eliminate any fissure therein. Furthermore, a layer of solvent-free thermo-melting glue (EVA, ethylene-vinyl acetate resin) is painted on an upper surface of the bearing board 5. Because the thermo-melting glue contains no solvent, the environment will not be contaminated thereby. The scaffold board painted with the thermo-melting glue has an about 70% increased breaking strength and an about 50% increased hardness which are not less than those of a wooden scaffold board. Therefore, the scaffold board of the present invention can be repeatedly used and recovered for reuse without polluting the environment.

In conclusion, the present invention has the following advantages:

1. The scaffold board of the present invention can be recovered for reuse without causing pollution of environment.
2. The present scaffold board has much less weight so that the transfer or displacement thereof can be easily performed.
3. The present scaffold board can be automatically mass-produced.
4. After being discarded, the present invention is subject to natural decomposition so that the environment will not be contaminated.
5. The area of the denuded forest can be reduced.
6. The present scaffold board is manufactured at lower cost so that the price thereof is reduced to enhance the competitive ability of the manufacturer.
7. The corrugated board is made of recovered waste paper and can be reused so that the natural resource can be best utilized.
8. The leg boards of the present scaffold board are composed of multiple vertically arranged corrugated boards so that the vertical compression strength thereof is increased to enhance the structural strength and hardness of the scaffold board.
9. The upper surface of the bearing board and the lower surface of the bottom board as well as two lateral sides of each leg board are reinforced by carton boards so that the bearing strength and collision-resistance of the scaffold board against the forklift are greatly increased.

It is to be understood that the above description and drawings are only used for illustrating one embodiment of the present invention, not intended to limit the scope of the present invention. Any variation and derivation from the above description and drawings should be included in the scope of the present invention.

What is claimed is:

1. A corrugated board-made scaffold board structure with high strength, comprising a bearing board and several leg boards disposed thereunder, said bearing board being composed of a lower longitudinal corrugated board, a middle transverse corrugated board and an upper longitudinal corrugated board which are attached to one another, each of said leg boards being composed of several corrugated boards attached to one another, shock-absorbing and supporting rib members being respectively disposed within corrugations of said lower, middle and upper corrugated boards for reinforcing the same, on an upper surface of said bearing board and two lateral sides of each said leg board being attached several layers of carton boards to increase bearing strength and collision-resistance of said bearing board and leg boards against a forklift.

2. A scaffold board structure as claimed in claim 1, wherein a bottom board composed of multiple corrugated boards is attached under said leg boards and several layers of carton boards are attached under a lower surface of said bottom board, shock-absorbing and supporting rib members being disposed in said corrugated boards of said bottom board for reinforcing the same.

3. A corrugated board-made scaffold board structure with high strength, comprising several bearing boards and several leg boards, wherein each of said bearing boards is composed of several corrugated boards having a relatively small width and attached to one another by thermo-melting glue, each of said corrugated boards being made of A-class flock paper with high compression strength and being vertically disposed, on two lateral sides of each said corrugated board being attached several carton boards for reinforcing the same, each of said leg boards being composed of several corrugated boards having a relatively large width and attached to one another by thermo-melting glue, on two lateral sides of each said corrugated board being attached several carton boards, shock-absorbing and supporting rib members being disposed within corrugations of said corrugated boards for reinforcing the same, said bearing boards and leg boards being connected in a cross pattern.

4. A scaffold board structure as claimed in claim 3, wherein several bottom boards composed of multiple corrugated boards are attached under said leg boards parallel to said bearing boards and several layers of carton boards are attached under lower surfaces of said bottom boards, shock-absorbing and supporting rib members being disposed in said corrugated boards of said bottom boards for reinforcing the same.

5. A scaffold board structure as claimed in claim 1, wherein a layer of solvent-free thermo-melting glue (EVA, ethylene-vinyl acetate resin) is painted on an upper surface of said bearing board for increasing bearing strength thereof.

6. A scaffold board structure as claimed in claim 3 wherein a layer of solvent-free thermo-melting glue (EVA, ethylene-vinyl acetate resin) is painted on an upper surface of said bearing board for increasing bearing strength thereof.

* * * * *